US011903434B2

(12) United States Patent
Miller et al.

(10) Patent No.: US 11,903,434 B2
(45) **Date of Patent: *Feb. 20, 2024**

(54) GARMENT LINER FOR IMPROVING COMFORT AND MAINTAINING PANT CLEANLINESS

(71) Applicant: Patrick Miller, Oakland, CA (US)

(72) Inventors: Patrick Miller, Oakland, CA (US); Christopher Wessels, San Francisco, CA (US)

(73) Assignee: Patrick Miller, Oakland, CA (US)

( * ) Notice: Subject to any disclaimer, the term of this patent is extended or adjusted under 35 U.S.C. 154(b) by 150 days.

This patent is subject to a terminal disclaimer.

(21) Appl. No.: 17/463,855

(22) Filed: Sep. 1, 2021

(65) Prior Publication Data

US 2022/0079275 A1 Mar. 17, 2022

Related U.S. Application Data

(63) Continuation of application No. 16/249,835, filed on Jan. 16, 2019, now Pat. No. 11,134,733.

(60) Provisional application No. 62/617,987, filed on Jan. 16, 2018.

(51) Int. Cl.

| | |
|---|---|
| ***A41D 27/04*** | (2006.01) |
| ***A41D 1/06*** | (2006.01) |
| ***A41B 9/00*** | (2006.01) |
| ***A41B 9/08*** | (2006.01) |
| ***A41F 7/00*** | (2006.01) |

(52) U.S. Cl.

CPC ..... *A41D 27/04* (2013.01); *A41B 9/001* (2013.01); *A41D 1/06* (2013.01); *A41F 7/00* (2013.01); *A41B 9/08* (2013.01)

(58) Field of Classification Search

CPC ..... A41D 27/04; A41D 1/06; A41D 27/02; A41D 27/12; A41D 2400/52; A41B 9/001; A41B 2400/52; A41F 7/00

See application file for complete search history.

(56) References Cited

U.S. PATENT DOCUMENTS

| | | | | |
|---|---|---|---|---|
| 4,561,121 | A * | 12/1985 | Ehring | A41D 13/00 2/458 |
| 9,403,044 | B2 * | 8/2016 | Pirone | A62B 17/00 |
| 11,134,733 | B2 * | 10/2021 | Miller | A41D 1/06 |
| 2004/0177427 | A1 * | 9/2004 | Pedrick | A41F 7/00 2/82 |
| 2011/0179556 | A1 * | 7/2011 | Partovi | A41D 1/08 2/243.1 |
| 2012/0011638 | A1 * | 1/2012 | Geary | A41F 1/00 2/336 |
| 2012/0117714 | A1 * | 5/2012 | Peck | A41D 31/185 2/228 |
| 2015/0113700 | A1 * | 4/2015 | Carrier | A41D 27/04 2/93 |
| 2018/0242661 | A1 * | 8/2018 | Giese | A41D 1/08 |

FOREIGN PATENT DOCUMENTS

JP 08013206 A * 1/1996

* cited by examiner

*Primary Examiner* — Daniel J Colilla

(57) ABSTRACT

Embodiments of the invention provide a garment liner that couples to the interior of a clothing article. The garment liner can replace typical underwear. The garment liner can shield clothing from a person's body, and can improve comfort by conforming to the shape of the clothing instead of to the body.

20 Claims, 9 Drawing Sheets

GARMENT LINER FOR IMPROVING COMFORT AND MAINTAINING PANT CLEANLINESS

CROSS-REFERENCES TO RELATED APPLICATIONS

This application is a continuation of U.S. application Ser. No. 16/249,835, filed on Jan. 16, 2019, which is a non-provisional application of and claims the benefit of the filing date of U.S. Provisional Application No. 62/617,987, filed on Jan. 16, 2018, which is herein incorporated by reference in its entirety for all purposes.

BACKGROUND

Underwear is often considered to be uncomfortable, and underwear typically has several features that can cause discomfort. For example, an elastic band is used to tighten around a person's waist in order to keep the underwear in place, and pressure caused by this elastic band can cause discomfort. Additionally, friction between underwear and pants can cause the underwear to move out of place, can cause underwear fabric to bunch, and can cause underwear to cling to sensitive areas. All of these situations can cause discomfort and can cause the wearer to regularly adjust and re-position underwear.

Embodiments of the present invention address these problems and other problems, individually and collectively.

SUMMARY

Embodiments of the invention provide a hygienic garment liner that attaches to the inside of clothes instead of directly to a person's body.

One embodiment of the invention provides a system for preserving cleanliness of clothing, the system comprising a clothing article and a garment liner. The garment liner includes at least one layer of fabric, and the garment liner is positioned within the clothing article. The garment liner is coupled to the clothing article.

Another embodiment of the invention provides a system for preserving cleanliness of clothing, the system comprising a clothing article, a garment liner, and a coupler. The garment liner includes at least one layer of fabric, and the garment liner is positioned within the clothing article. The garment liner is coupled to the clothing article by the coupler.

Another embodiment of the invention provides a system for preserving cleanliness of clothing, the system comprising a clothing article and a garment liner. The garment liner is positioned within the clothing article. The garment liner includes a first outer layer and a second inner layer attached to the first outer layer. The first outer layer includes a first material that is configured to attach to the clothing article. The first outer layer is in contact with the clothing article. The second inner layer includes a second material configured for comfort. The second inner layer is positioned to contact a person's body.

Another embodiment of the invention provides a garment liner. The garment liner includes at least one layer of fabric, and the garment liner is positioned within a clothing article. The garment liner is coupled to the clothing article by a coupler.

Another embodiment of the invention provides a garment liner. The garment liner is positioned within a clothing article. The garment liner includes a first outer layer and a second inner layer attached to the first outer layer. The first outer layer includes a first material that is configured to attach to the clothing article. The first outer layer is in contact with the clothing article. The second inner layer includes a second material configured for comfort. The second inner layer is positioned to contact a person's body.

Further details regarding embodiments of the invention can be found in the Detailed Description and the Figures.

DETAILED DESCRIPTION

Figure 1A:
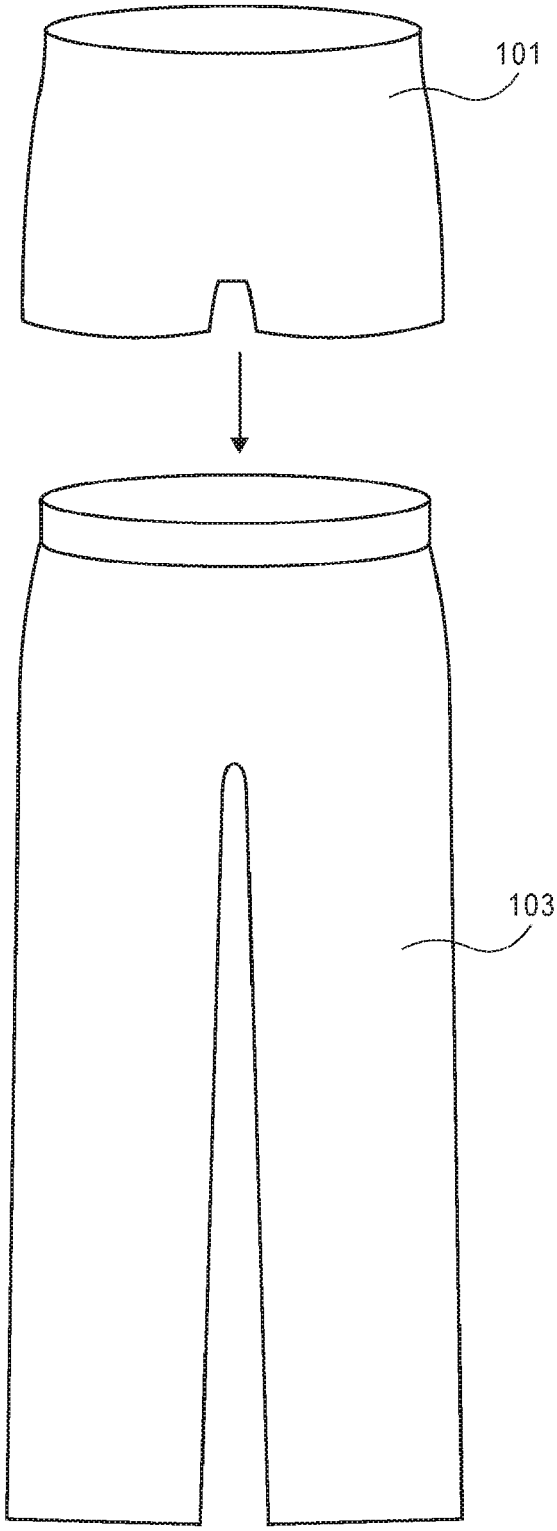
FIGS. 1A-1B show a diagram of a garment liner that can replace typical undergarments, according to embodiments of the invention.

Embodiments of the invention provide a hygiene-maintaining garment liner that can be used to replace underwear. Instead of attaching directly to the body, as per conventional underwear, the garment liner couples to an article of clothing.

Prior to discussing specific embodiments of the invention, some terms may be described in detail.

A "clothing article" may include an item worn to cover the body. Examples of a clothing article include a pair of pants, a pair of shorts, a skirt, a dress, a kilt, trousers, a shirt, a sweater, a coat, a hat, a pair of shoes, etc.

An "garment liner" may include a lining for a clothing article. A garment liner can be coupled to the interior of a clothing article. A garment liner can include any suitable materials and fabrics, and can include multiple layers of material. Example materials that can be included in a garment liner include cotton, cotton blends, silk, linen, fleece, napped fabrics, velvet, micro fleece, velours, woven interlocks, combinations like cotton-polyester, wool-silk, other synthetic fabrics, felts, wool, leather, cotton, adhesives, synthetics, self-adhering cohesive bandage materials, gripping fibers and rubbers, etc.

A "garment liner" can alternatively be referred to as a "liner," a "shield," or a "garment shield." Further, a "clothing article" can alternatively be referred to as a "garment," and a "garment liner" can alternatively be referred to as a "clothing article liner." However, to avoid confusion between components, the terms "clothing article" and "garment liner" will be primarily used herein.

A "coupler" may include a thing that connects two things. A coupler can connect a garment liner to a clothing article. Examples of couplers include buttons, snaps, clips, magnets, Geckskin™, Velcro™, adhesives, strings, loops, hooks, snap hooks, shirt stays, rubber pads, two-sided stickers, tapes, and any other suitable device for coupling, attaching, or connecting a garment liner to a clothing article.

The garment liner can be coupled to or directly attached to the inside of a clothing article using any suitable materials, mechanisms, designs, or techniques. As examples, the garment liner can attach to a clothing article using felt, magnets, buttons, Geckskin™, Velcro™, adhesives, strings, loops, hooks, rubber, clips, etc.

Since the garment liner can be coupled to the inside of a clothing article, the garment liner can exclude features that are typically included in underwear, and that typically cause discomfort. For example, the garment liner can exclude an elastic band, as the garment liner may not need to cling directly to a person's body. Additionally, the garment liner may not be shaped or configured to fit snugly to certain areas of a person's body, such as the hips, thighs, buttocks, or groin. Instead, in some embodiments, the garment liner can take the shape of the clothing article to which it is attached, or the garment liner can hang loosely from the clothing article.

Embodiments allow the garment liner to have any suitable shape, style, and configuration. For example, the garment liner can take the shape of or approximate the shape of boxer underwear or of brief underwear. The garment liner can extend to the top of the clothing article, or can attach lower to have a more low-cut design. Leg-covering portions of the garment liner can extend as low as desired, such as to the mid-thigh or the knee. In some embodiments, the garment liner can be separated into multiple portions, such as a groin portion, a buttocks portion, one or more thigh portions, and any other suitable portion, such that separate portions can cover and/or cushion any suitable areas of the body.

Embodiments allow the garment liner can include one or more materials. For example, the garment liner can include a soft, comfortable inner-layer material that contacts a person's skin (e.g., silk, cotton, fleece), and can also include an outer-layer material that is better suited for attaching to clothes.

In some embodiments, the garment liner can be removable from clothing. Additionally, the garment liner can be re-usable, re-attachable, and/or washable.

Accordingly, by coupling to a clothing article instead of to the body, the garment liner can go without uncomfortable elastic straps and uncomfortable tight, body-hugging sections of fabric. Also, when the garment liner is attached to a clothing article, there may be no (or reduced) relative movement or friction between the clothing article and garment liner. This can prevent bunching of the garment liner material, prevent clinging to sensitive body areas, and/or otherwise prevent movement of the garment liner into uncomfortable positioning. Further, a garment liner can have thinner fabric than conventional underwear, as a garment liner may not need to have as much strength as conventional underwear (e.g., which may need strength for attaching to the body and resisting wear). A garment liner can by limited in size and shape such that is only covers sensitive areas, and the garment liner can thereby cover less body surface area such that fabric amounts are further reduced. Reducing fabric can reduce the frequency and severity of fabric bunching, can reduce bulkiness, and can reduce the weight of the garment liner. While achieving these benefits of comfort, the garment liner can still maintain the cleanliness of the clothing article by acting as a changeable barrier between body and clothing. The garment liner can also include cushioning for protection of sensitive body areas, such as the groin.

As mentioned above, the underwear-replacing and cleanliness-maintaining garment liner can be a composite of multiple materials. For example, a garment liner can include an inner material designed for comfort and/or liquid absorption, an outer material with properties that enable attachment to clothes, and/or one or more supportive or structural middle layers.

Examples of inner materials include cotton, cotton blends, silk, linen, fleece, napped fabrics, velvet, micro fleece, velours, woven interlocks, combinations like cotton-polyester, wool-silk, other synthetic fabrics, and/or any other suitable material considered comfortable, that has moisture-wicking properties, that has temperature regulating properties, and/or that has liquid absorbing properties.

Examples of outer materials include any suitable material for coupling to clothes (e.g., adhering to cotton, synthetics, and other clothing materials), for resisting wear, and/or for providing structure. These can include felts, wool, leather, cotton, adhesives, synthetics, self-adhering cohesive bandage materials, gripping fibers and rubbers, etc. Some adhesive materials may deteriorate over time and after usage or washing, and may be replenished by adding a fresh adhesive coating.

Additional materials that can be used are described in U.S. Pat. Nos. 7,503,078 and 7,240,375, both of which are incorporated by reference herein.

In some embodiments, a coupling between a garment liner and a clothing article can be somewhat weak. For example, there may be pressure between the body (e.g., legs) and clothing (e.g., pants), especially in tight-fitting pants. This pressure can act as a contributing force for keeping a garment liner coupled to, contained within, and correctly positioned within a clothing article. Accordingly, the garment liner may not need to be configured to fully resist gravity, as an attachment may be assisted by body-pressure. As a result, garment liner materials can be lighter and/or weaker than typical undergarments, and as a result a garment liner may be less noticeable to the wearer and more comfortable. The garment liner may only be strong enough to resist friction between the body and clothing. In some embodiments, this can be achieved by using a higher-friction outer material that contacts the clothing, and a lower-friction inner material that contacts the body.

In addition to having different outer materials and inner materials, the garment liner can vary in thickness and materials across different sections and surfaces. For example, a thicker or more absorbent material can be used in the inguinal region, and a thinner and more lightweight material can be used on the outer legs.

In addition to fabric, other devices for attaching the garment liner to clothing can be included on the garment liner. These can include buttons, clips, magnets, loops, strings, hooks, Velcro™, shirt stays, rubber pads, or any other suitable tools. Reciprocal counterpart attachment devices can be included as a portion of the clothing article (e.g., permanently, semi-permanently, or temporarily). For example, a reciprocating coupling device (e.g., a Velcro™ counterpart) can be connected to the clothing article by sewing, gluing, or any other suitable means. In other embodiments, a clothing article can be originally constructed to include one or more of these materials and attachment devices, instead of being added at a later time.

In some embodiments, two-sided stickers, tapes, Geckskin™, or other adhesive materials can be used to attach a garment liner to a clothing article. These can be replaceable one-time use components, or may be reusable.

In some embodiments, a garment liner can be connected to a power source (or other source of electric current) and charged, and then may attach to a clothing article via static cling.

Several examples of garment liners and systems for coupling a garment liner to a clothing article are shown in FIGS. 1-10.

FIG. 1A shows an example of a garment liner 101 and a clothing article 103 within which the garment liner 101 can be placed. The garment liner 101 can be lowered into the inside of the clothing article 103, and then coupled to the clothing article 103 in any suitable manner. Then, a person can adorn themselves with the clothing article 103 (e.g., put on the pants) which is now protected by the garment liner 101.

Figure 1B:
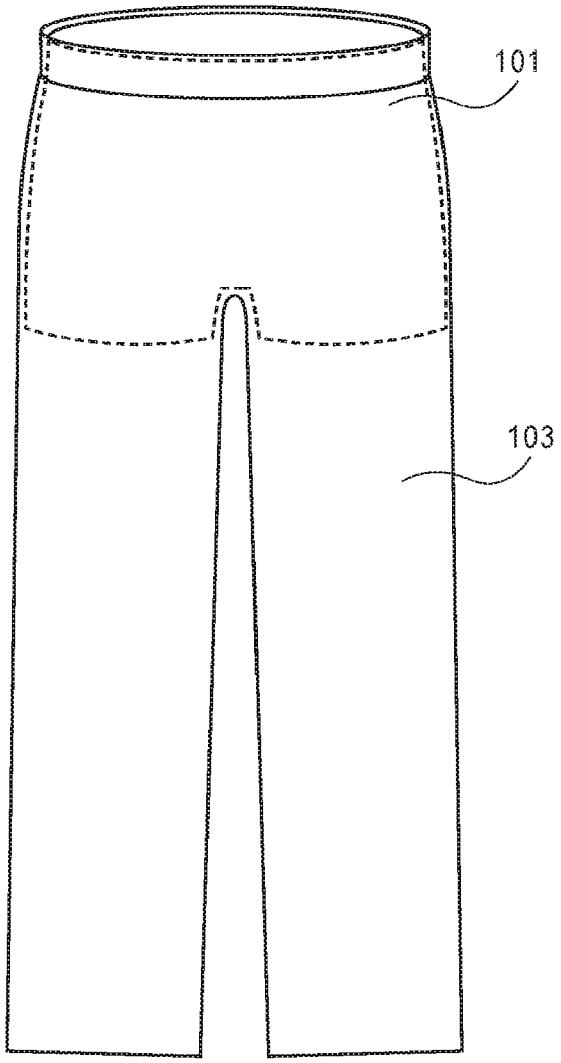

FIG. 1B shows an example of the garment liner 101 as positioned within and coupled to the clothing article 103. The outline of the garment liner 101 is shown in dotted lines in order to illustrate the that garment liner 101 is inside the clothing article 103.

In some embodiments, the garment liner 101 can be readily removed from the clothing article 103. For example, a person may replace and/or wash the garment liner 101 each day or after each use. The garment liner 101 can protect the clothing article 103 from being directly exposed to bodily areas prone to bacteria and odor (e.g., the buttocks), and as a result the clothing article 103 can remain clean.

As mentioned above, the garment liner 101 may include materials that attach directly to the clothing article 103. As an example, the garment liner 101 and clothing article 103 can both include felt material, such that the when the garment liner 101 is pressed against the clothing article 103, the garment liner 101 becomes attached to the clothing article 103. Other materials may achieve the same result, such as self-adhering bandage material, Geckskin™, Veltex™, adhesives, etc. Accordingly, in some embodiments, FIG. 1B can be a complete portrayal of the clothing system.

Figure 2:
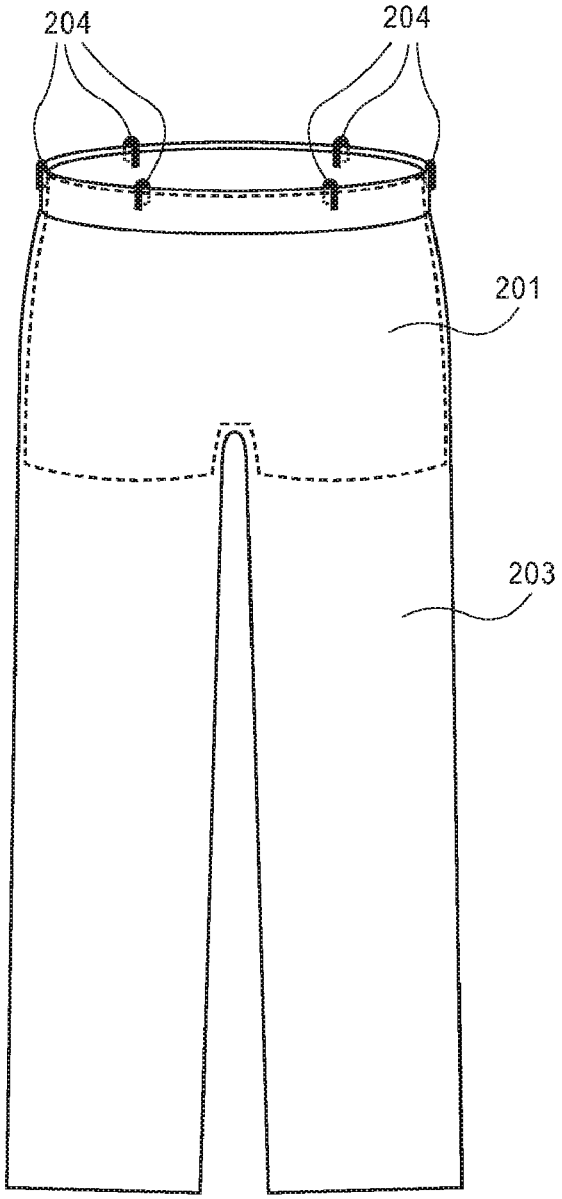
FIG. 2 shows an illustration of a first example of couplers for connecting a garment liner to a clothing article, according to an embodiment of the invention.

Other embodiments can include additional components for coupling a garment liner to a clothing article. For example, FIG. 2 illustrates multiple clips 204 that can be used to couple a garment liner 201 to a clothing article 203. The clips 204 can be placed over the top edge of both the garment liner 201 and the clothing article 203, and can apply pressure to the outside of the clothing article 203 and the inside of the garment liner 201 such that the garment liner 201 and the clothing article 203 are pressed against. As a result, the garment liner 201 and the clothing article 203 can be held together by external pressure.

The clips 204 can take any suitable form. For example, a clip 204 can be take the form of a single U-shaped device. In other embodiments, a clip 204 can include multiple rigid pieces that are connected together and apply inward pressure via a spring mechanism. In some embodiments, a clip 204 can be a clothespin, or a modified version of a clothespin that is smaller and less noticeable when used.

The clips 204 can include metal, plastic, wood, and any other suitable materials. In some embodiments, the clips 204 can alternatively or additionally include hooks, such as a first hook that attaches to the top edge of the clothing article 203 and/or a second hook that grabs onto the garment liner 201.

In some embodiments, the clips 204 can be the only mechanism for coupling the garment liner 201 and the clothing article 203. For example, the garment liner 201 and the clothing article 203 may not include or require special fabrics or other materials for connecting to one another. However, embodiments allow the clips 204 to be used in combination with other connective or attractive materials, and in combination with other coupling mechanisms described herein.

Figure 3:
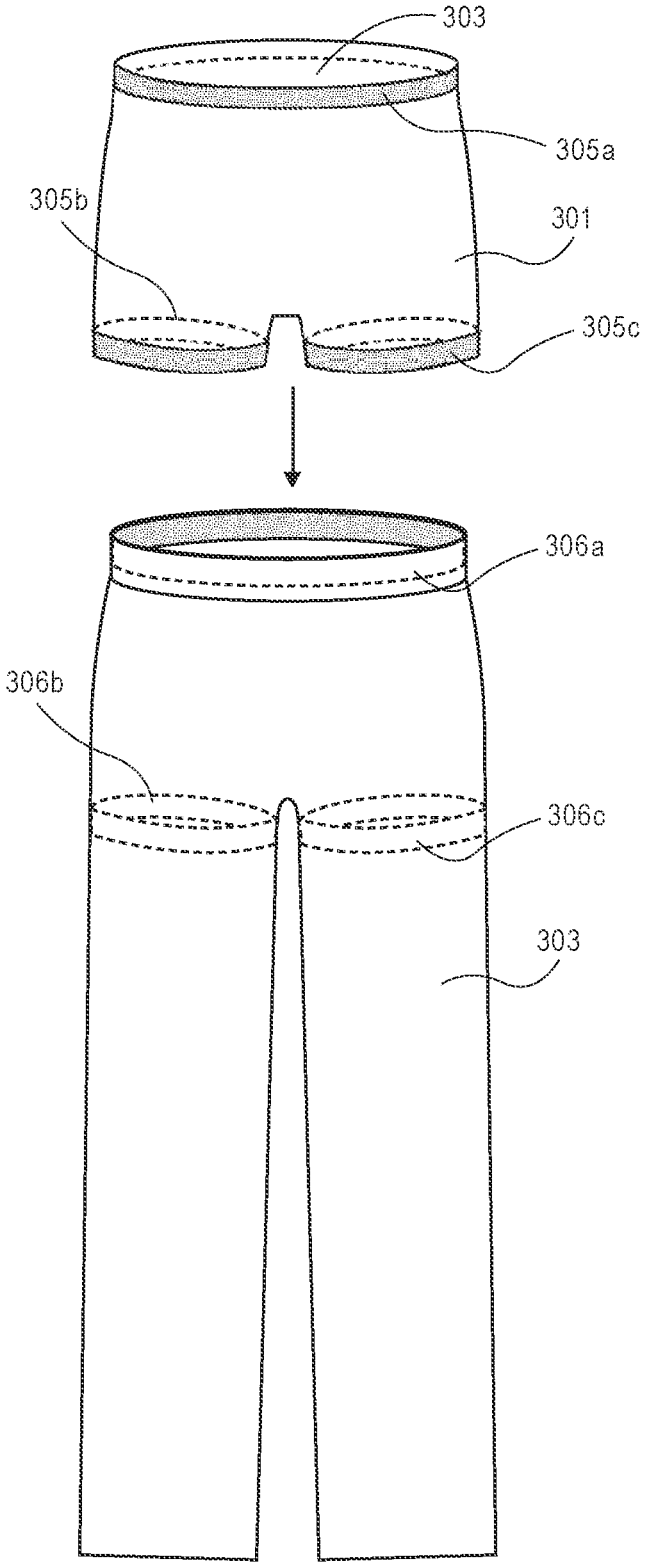
FIG. 3 shows an illustration of a second example of couplers for connecting a garment liner to a clothing article, according to an embodiment of the invention.

Additional examples of components for coupling a garment liner to a clothing article are shown in FIG. 3, according to an embodiment of the invention.

In FIG. 3, a garment liner 301 includes a set of liner couplers 305A-C, and a clothing article 303 includes a corresponding set of clothing couplers 306A-C. The liner couplers 305A-C and the clothing couplers 306A-C can attach to each other, thereby coupling the garment liner 301 and the clothing article 303.

In some embodiments, the liner couplers 305A-C can be permanently affixed to the garment liner 301, and the clothing couplers 306A-C can be permanently affixed to the clothing article 303. In other embodiments, the liner couplers 305A-C can be temporarily and removably affixed to the garment liner 301, and the clothing couplers 306A-C can be temporarily and removably affixed to the clothing article 303.

The liner couplers 305A-C and the clothing couplers 306A-C can include magnets, Velcro™, Veltex™, Geckskin™, and/or any other suitable materials or tools. In the case of magnets, embodiments allow each coupler (e.g., shown as a ring in FIG. 3) to be one continuous magnet, or can be two or more discrete magnet pieces arranged together (e.g., to form a ring). Similarly, when made of other materials (e.g., Velcro™, Veltex™, Geckskin™), each coupler can take the form of a continuous strip, or of smaller separate pieces used in combination. As an example of smaller separate pieces, the couplers can be embodied as four separate portions (e.g., a front portion, a back portion, and two side portions) arranged together to form a complete or partial ring.

In some embodiments, the liner couplers 305A-C and the clothing couplers 306A-C can include magnets, and the magnets can be installed and contained within fabric layers of the garment liner 301 and/or the clothing article 303. As a result, the magnets can be securely positioned within the fabric and protected from damage. In this case, the liner couplers 305A-C and the clothing couplers 306A-C would not directly touch one another, but could still maintain magnetic tension across interceding fabric layers. In other embodiments, magnets can be external to the fabric in order to facilitate easy replacement.

If potentially abrasive materials are used, such as Velcro™, they can be arranged to reduce the likelihood of irritation. For example, the hook portion of Velcro™, which is typically more abrasive, can be placed on the garment liner 301 so as to face away from the person's body. The loop portion of the Velcro™, which is typically softer and less abrasive, can be placed on the clothing article 303. Alternatively, these portions can be arranged in the opposite manner, or both hook portions and loop portions can be included on both the clothing article 303 and the garment liner 301.

Embodiments allow the liner couplers 305A-C and the clothing couplers 306A-C to be strategically positioned on the clothing article 303 and the garment liner 301 to enable a secure connection, to hold the garment liner 301 in a specific position, and to promote comfort. For example, a first liner coupler 305A can take the shape of a ring encircling an upper area or upper edge of the garment liner 301 (e.g., on the exterior surface of the garment liner 301). A matching counterpart of a first clothing coupler 306A can take the shape of a ring positioned at an upper area or upper edge of the clothing article 303 (e.g., on the interior surface of the clothing article 303). The connection of the first liner coupler 305A to the first clothing coupler 306A can provide vertical support to the garment liner 301, thereby preventing the garment liner 301 from slipping downward.

A second liner coupler 305B can take the shape of a ring encircling a right leg area or a bottom edge of a right leg portion of the garment liner 301. A matching counterpart of a second clothing coupler 306B can take the shape of a ring positioned at a right leg portion of the clothing article 303 (e.g., on the interior surface of the clothing article 303). Similarly, a third liner coupler 305C can take the shape of a ring encircling a left leg area or a bottom edge of a left leg portion of the garment liner 301. A matching counterpart of a third clothing coupler 306C can take the shape of a ring positioned at a left leg portion of the clothing article 303 (e.g., on the interior surface of the clothing article 303). The connection of the second liner coupler 305B to the second clothing coupler 306B and the connection of the third liner coupler 305C to the third clothing coupler 306C can affix the bottom end of the garment liner 301, thereby preventing the garment liner 301 from rising, bunching, or otherwise moving out of place.

The combination of the three connections can create tension throughout the garment liner 301. Tension throughout the garment liner 301 can cause the garment liner 301 to be firmly coupled to the inner surface of the clothing article 303, can cause the garment liner 301 to be held in a stretched state. The firm coupling, tension, and stretched state can prevent the garment liner 301 from clinging to a person's body, from bunching inside body crevices, and from otherwise causing discomfort.

Figure 4:
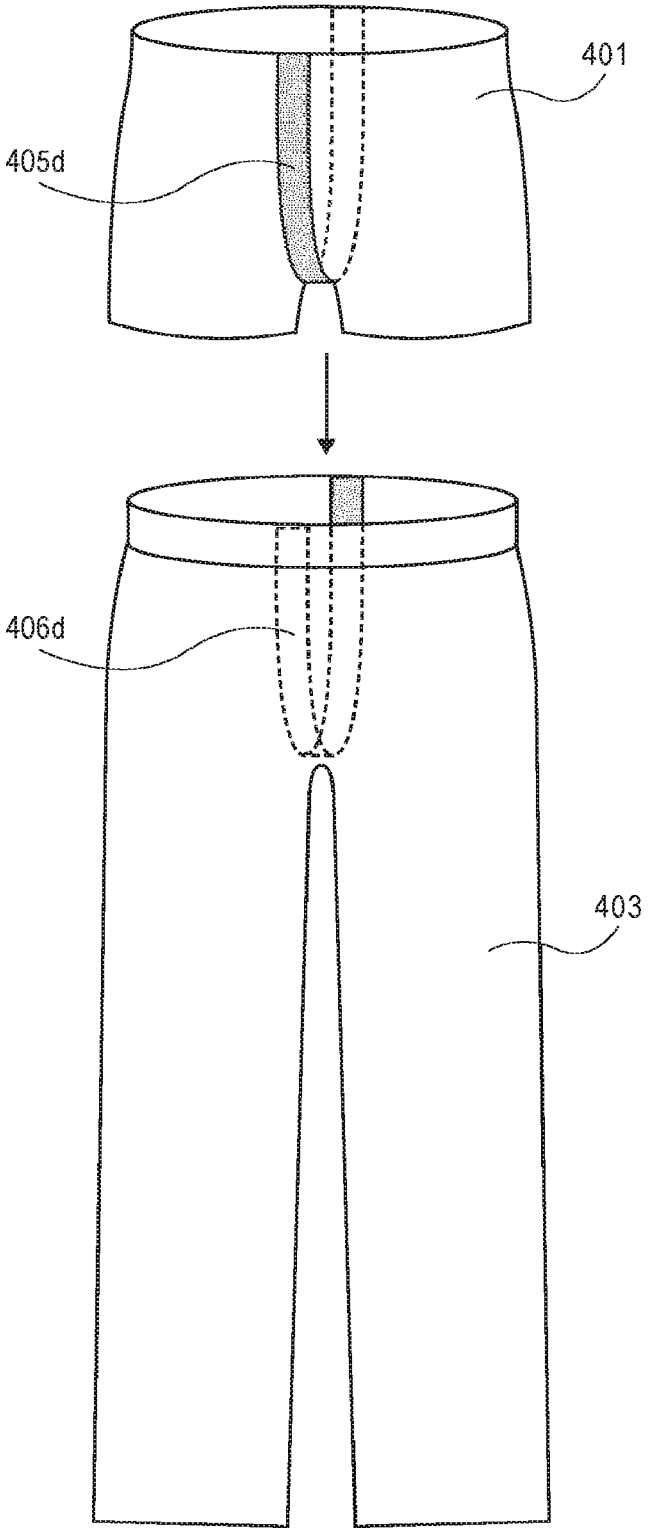
FIG. 4 shows an illustration of a third example of couplers for connecting a garment liner to a clothing article, according to an embodiment of the invention.

Comfort can be promoted by adding additional couplers to specific, sensitive areas that may be prone to bunching and discomfort. For example, FIG. 4 shows an additional area of connection positioned in the saddle area. A fourth coupler 405D be a strip that extends from an upper area or upper edge in the front of the garment liner 401 (e.g., on the exterior surface of the garment liner 401) down through the center groin area of the garment liner 401 and then up to an upper area or upper edge in the rear of the garment liner 401. A matching counterpart of a fourth clothing coupler 406D can be a strip that extends from an upper area or upper edge in the front of the clothing article 403 (e.g., on the interior surface of the clothing article 403) down through the center groin area of the clothing article 403 and then up to an upper area or upper edge in the rear of the clothing article 403.

The connection of the fourth coupler 405D to the fourth clothing coupler 406D can affix the groin and saddle areas of the garment liner 301. The shape and position of this affixed area can reduce the tendency of the garment liner 401 to bunch into groin crevices, between the legs, and into the inter-gluteal cleft.

These couplers in the saddle region can be used in conjunction with the components shown in FIG. 3 (or other suitable configurations) in order to increase tension and stability. Also, as mentioned, above the fourth coupler 405D and the fourth clothing coupler 406D may or may not take the form of one continuous strip. For example, in some embodiments, the fourth coupler 405D and/or the fourth clothing coupler 406D can instead be divided into segments, some of which may be widened or adjusted in any suitable fashion.

Figure 5:
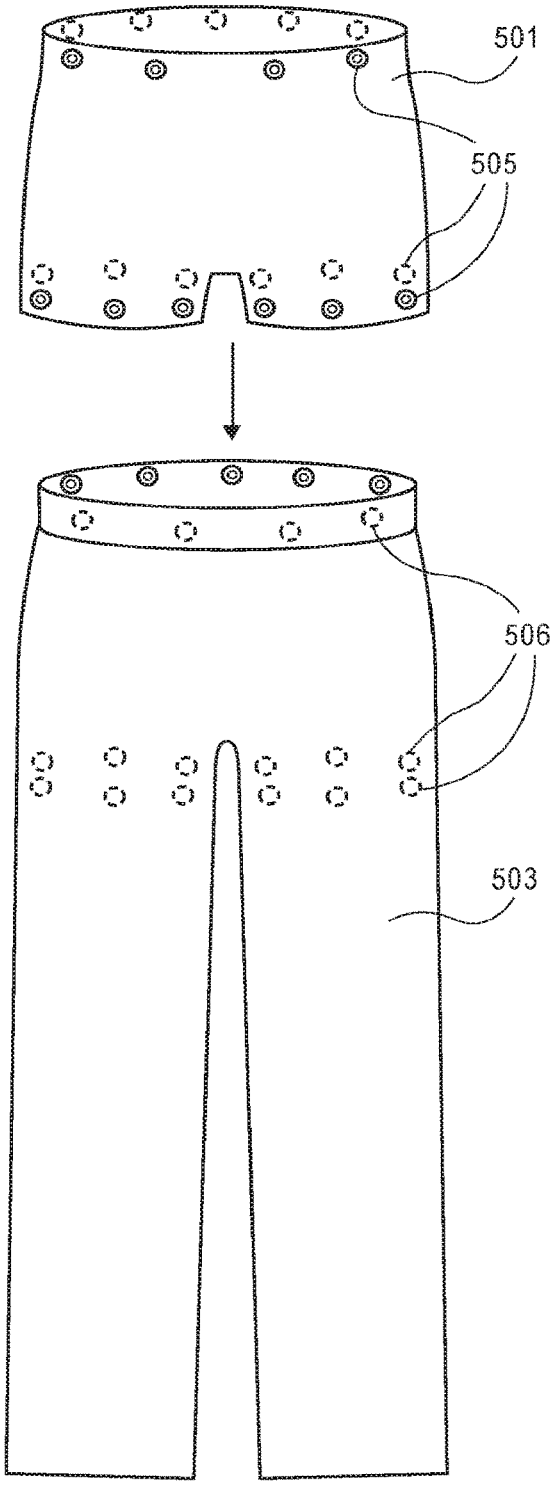
FIG. 5 shows an illustration of a fourth example of couplers for connecting a garment liner to a clothing article, according to an embodiment of the invention.

FIG. 5 illustrates a garment liner 501 with one or more smaller, more discrete liner couplers 505 and corresponding clothing couplers 506. For example, these liner couplers 505 and clothing couplers 506 can take the form of buttons and buttonholes, snap buttons, clips, small Velcro™ patches, individual magnet portions, strings (or other tying materials) and string-attachment points (e.g., loops), or any other suitable attachment component.

To promote comfort, embodiments allow abrasive or pointed components to face away from a person's body, for example by being placed on the outer surface of the garment liner 501. For example, the male portion of the snap button can be placed on the garment liner 501, while the female portion of the snap button can be place on the clothing article 503. This way, if the clothing article 503 is worn without the garment liner 501, the less-pointed female portion may be present instead of the more-pointed male portion.

In some embodiments, the clothing couplers 506 can take the form of clips that can grab onto the upper ring edge of the garment liner 501, or that portions of the garment liner 501 can be inserted into. The clips can use magnets, springs, or other suitable means to grip the garment liner 501. As a result, the liner couplers 505 can be excluded, such that the liner 501 only includes fabric. In some embodiments, these clips can be permanently attached to the interior of the clothing article 503.

In other embodiments, the liner couplers 505 and clothing couplers 506 can both take the form of belt loops. Then, a single belt, string, or other attachment device can be inserted through belt loops of both the garment liner 501 and the clothing article 503, coupling the two together. There can be multiple belted areas as desired (e.g., a waist belt, and two leg belts).

Additionally, in some embodiments, instead of including Velcro™ portions on both the garment liner 501 and the clothing article 503, self-adhering Velcro™ tabs or strips can be used. For example, the clothing couplers 506 can be implemented as loops of fabric (e.g., belt loops), and the liner couplers 505 can take the form of strips of Velcro™ containing a first section of Velcro™ hooks and a second section of Velcro™ loops. The Velcro™ strip can be inserted through the fabric loops and then connected to itself, thus securing the garment liner 501 to the clothing article 503. A similar result can be achieved using tabs or string with snap buttons (both sides of the button), or with magnets (both sides of the magnet on a single tab).

In some embodiments, the garment liner 501 can include a built-in waist-tightening string or belt. This can be tightened to match a waist perimeter of the interior of the clothing article 503. As a result, a single garment liner 501 can conform to multiple different waist sizes.

Figure 6:
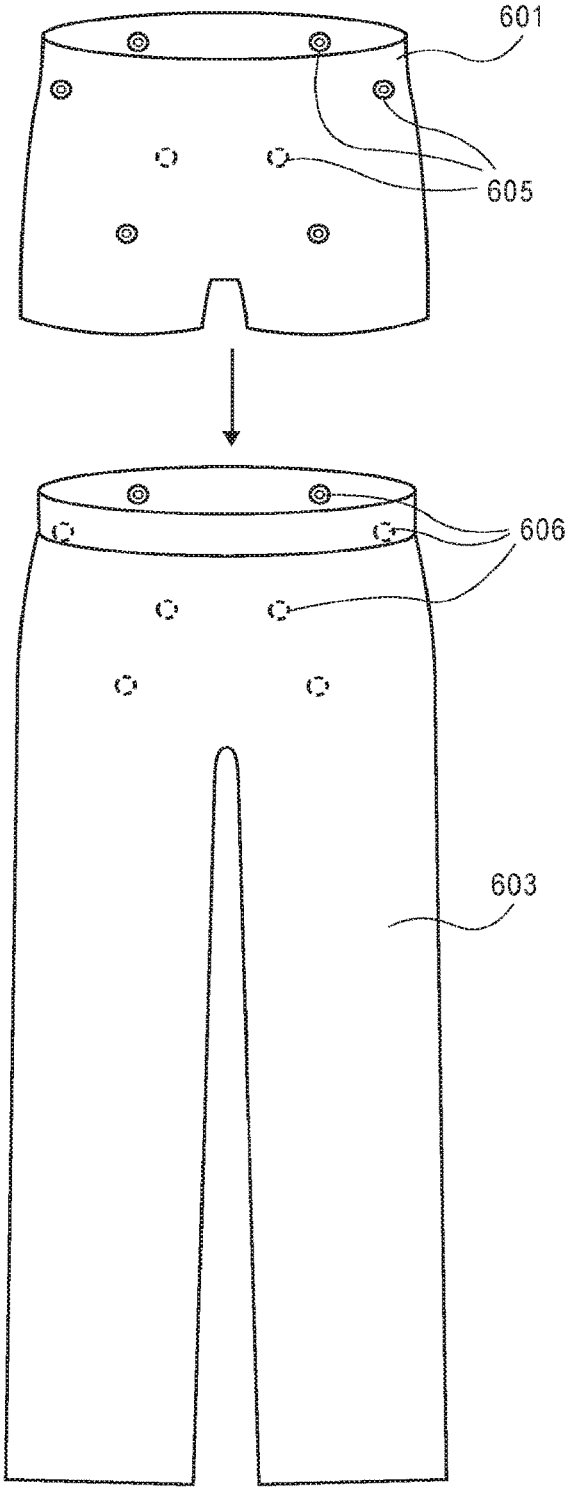
FIG. 6 shows an illustration of a fifth example of couplers for connecting a garment liner to a clothing article, according to an embodiment of the invention.

FIG. 6 shows a garment liner 601 that includes an alternative configuration of liner couplers 605 and corresponding clothing couplers 606. These components can be positioned near the hips, in the middle, top, and/or bottom of each buttock, on the thighs, or on any suitable area that provides a stable garment liner 601 attachment and promotes comfort.

In some embodiments, a garment liner can be composed of different materials in different areas. For example, a lighter and more elastic material can be used in the saddle region to promote flexibility and breathability. In some embodiments, a rear portion of a garment liner can include an material with greater elasticity. Further, in some embodiments, a rear portion of a garment liner may be stretched in order to align buttocks-positioned couplers. This stretching can provide extra tension over the inter-gluteal cleft so as to prevent bunching and clinging within or near the inter-gluteal cleft.

In some embodiments, a garment liner can be attached directly to a typical clothing article without making any modifications to the clothing article. For example, a garment liner can be applied to a clothing article without using any of the attachment devices or couplers described above. This can be achieved by using special garment liner materials that can connect to typical clothing materials, or by applying a connective material to the garment liner. For example, as discussed above with respect to FIG. 1, a self-adhering bandage material, Geckskin™, Veltex™, adhesives, or other suitable materials can be used to attach a garment liner to unmodified clothing articles. As another example, a static charge may be applied to a garment liner before inserting into a clothing article, and then the garment liner may attach to the clothing article via static cling.

Figure 7A:
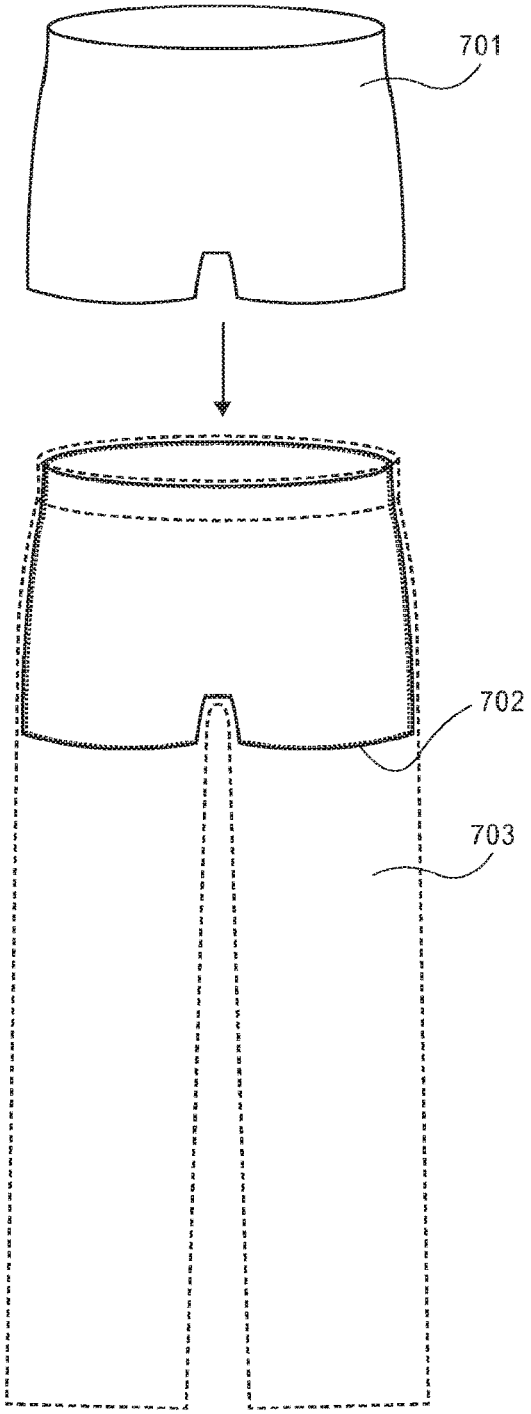
FIGS. 7A-7B show illustrations of a sixth example of couplers for connecting a garment liner to a clothing article, according to an embodiment of the invention.
Figure 7B:
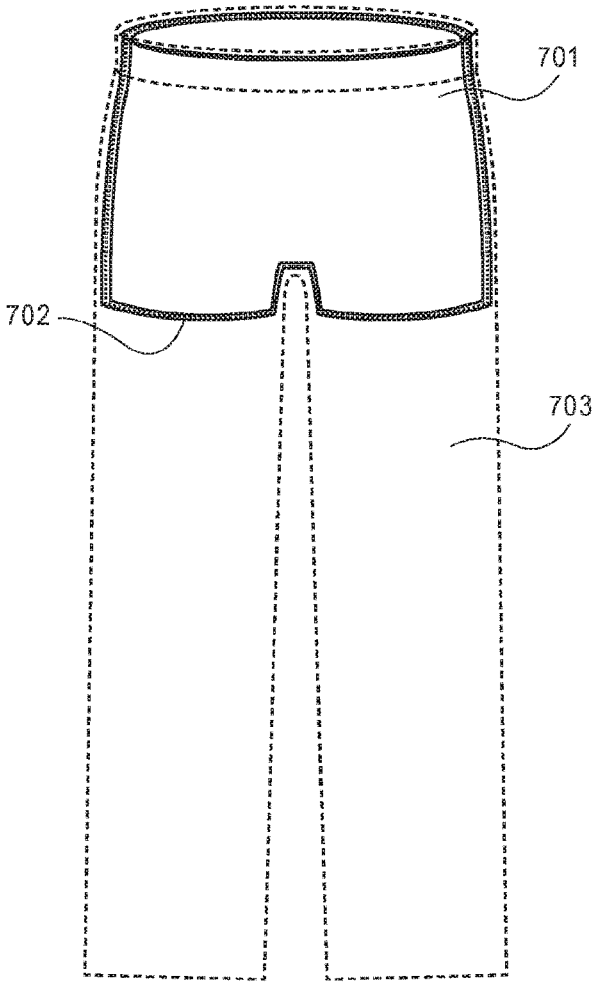

FIGS. 7A-7B show another type of coupler 702 that can be used to couple a garment liner 701 to a clothing article 703, according to embodiments of the invention. The coupler 702 can be coupled to the interior surface of the clothing article 703, as shown in FIG. 7A. Then, the garment liner 701 can be coupled to the coupler 702, and thereby coupled to the clothing article 703, as shown in FIG. 7B.

Dotted lines in other figures are used to illustrate items that are not in direct line-of-sight (e.g., items that are within or behind another item). However, in FIGS. 7A-7B, dotted lines are used differently. Here, the clothing article 703 is illustrated as dotted lines in order to draw more attention to and differentiate from the coupler 702 and the garment liner 701. Regardless of which lines are dotted, embodiments allow the clothing article 703 to be the outermost item, the coupler 702 to be the middle item, and the garment liner 701 to be the innermost item. This convention also applies to FIG. 8.

As illustrated in FIGS. 7A-7B, the coupler 702 can have a similar shape and size as the garment liner 701. The coupler 702 can include one or more fabric materials, and can be configured to attach to the garment liner 701.

In some embodiments, the garment liner 701 and the coupler 702 can attach to one another by including materials that stick to or are otherwise attracted to one another. In one example, the garment liner 701 and coupler 702 can both include felt material, such that the garment liner 701 becomes attached to the coupler 702 when pressed against the coupler 702. Other materials may achieve the same result, such as self-adhering bandage material, Geckskin™, or Veltex™.

Embodiments allow the coupler 702 to be initially attached to the clothing article 703 by any suitable means, such as sewing, ironing-on, adhesives, clips, etc. The coupler 702 can be permanently attached to the clothing article 703, and may be washed with the clothing article 703 without being damaged or removed. In some embodiments, the coupler 702 can be manufactured as part of the clothing article 703. For example, a portion of the clothing article 703 material (e.g., cotton or denim) can be replaced by the coupler 702 in that region.

In some embodiments, the garment liner 701 and the coupler 702 can have the same or similar shape and/or dimensions, such that the entire outer surface of the garment liner 701 attaches to the entire inner surface of the coupler 702. Alternatively, the coupler 702 can be larger than the garment liner 701, which can allow extra buffer space on the coupler 702 to ensure that the entire surface of the garment liner 701 is able to cling to the coupler 702 (e.g., so there is no free hanging material). In some embodiments, the coupler 702 can cover most of or the entire interior of the clothing article 703, which can provide extra comfort and/or insulation. In other embodiments, the coupler 702 may be smaller than the garment liner 701. For example, the coupler 702 can be minimized and positioned only in primary connection areas. This can reduce weight and bulkiness.

Figure 8:
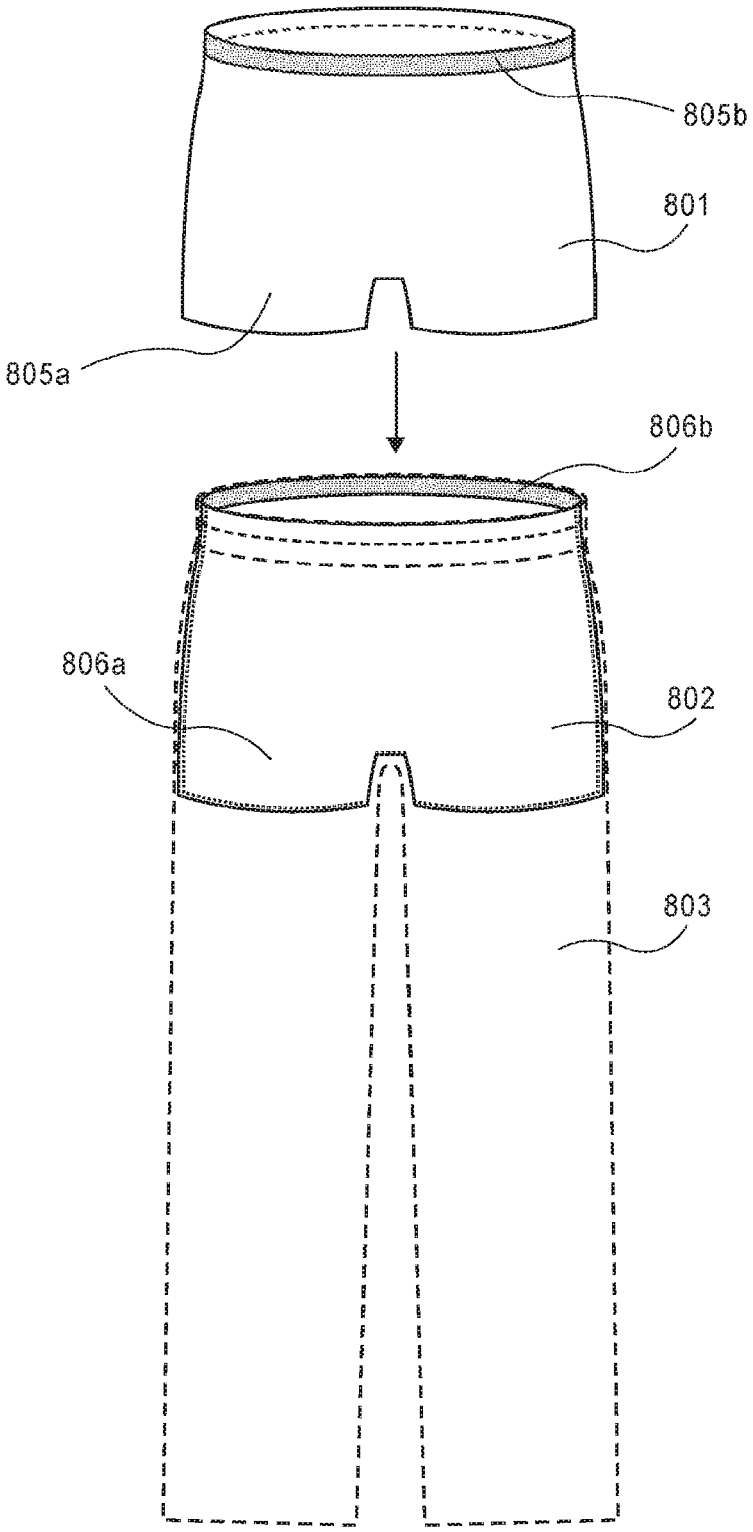
FIG. 8 shows an illustration of a seventh example of couplers for connecting a garment liner to a clothing article, according to an embodiment of the invention.

As mentioned above, embodiments allow the various materials, couplers, and mechanisms for coupling a garment liner to a clothing article described herein to be combined in any suitable fashion. FIG. 8 demonstrates one such possible combination. FIG. 8 combines elements of FIG. 7A and FIG. 3. In comparison with FIG. 7A, FIG. 8 can provide a more secure coupling by incorporating an additional gravity-bracing feature.

FIG. 8 shows a garment liner 801 with a first liner coupler 805A and a second liner coupler 805B. The garment liner 801 can attach to a clothing article 803 via an intermediary coupler 802 that includes both a first element 806A and a second element 806B, according to embodiments of the invention.

The first liner coupler 805A and the first element 806A can be configured to connect to one another. These components can have similar materials, configuration, shape, and attachment properties as described above with respect to FIGS. 7A-7B.

The second liner coupler 805B and the second element 806B can be used to provide an additional connection for resisting downward gravitational force. In some embodiments, this second connection can be stronger than the first connection. These components can have similar materials, configuration, shape, and attachment properties as described above with respect to FIGS. 3-6 (e.g., hooks and hook receiving loops, magnets, Velcro™, buttons, clips, snaps, snap hooks, or any other suitable fasteners).

In this case, the second liner coupler 805B may create a primary, stronger coupling that provides the main support, and the first liner coupler 805A may create a second, weaker coupling that provides additional support in areas of secondary concern (e.g., the outer thighs), that keeps the liner from bunching, that keeps all points of the liner in place, and that provides additional padding for comfort.

Figure 9A:
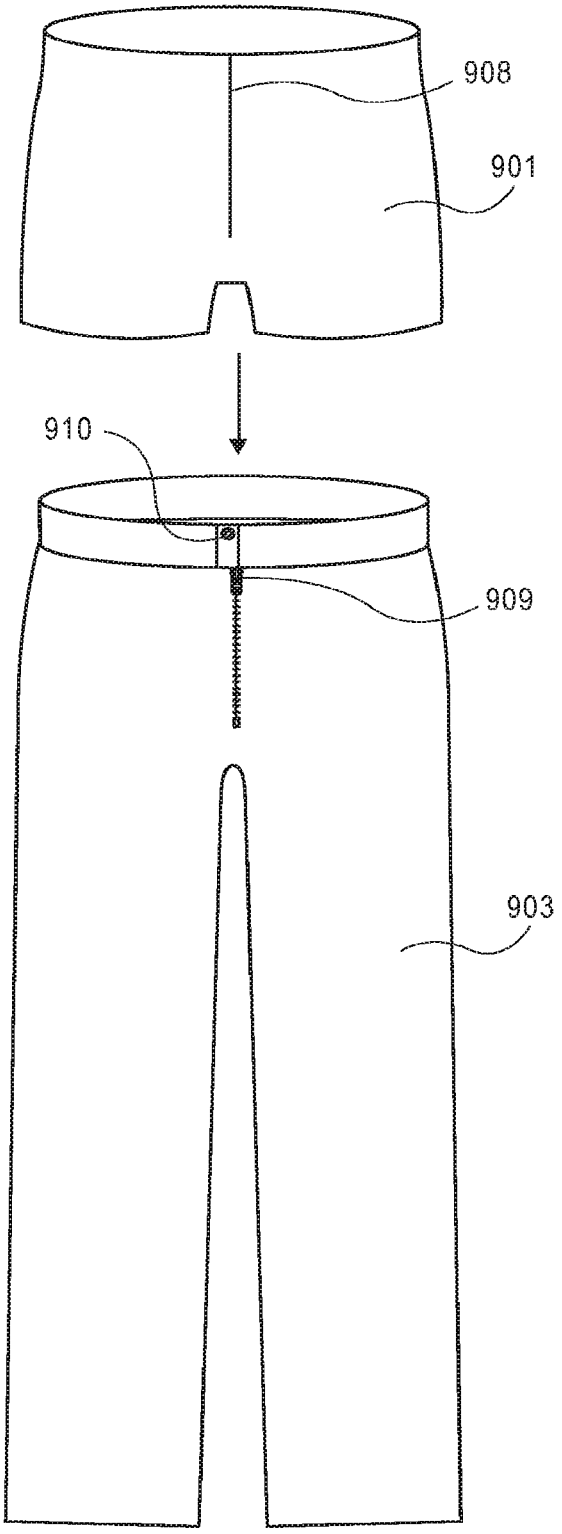
FIGS. 9A-9B show an illustration of a garment liner with a slit opening, according to an embodiment of the invention.
Figure 9B:
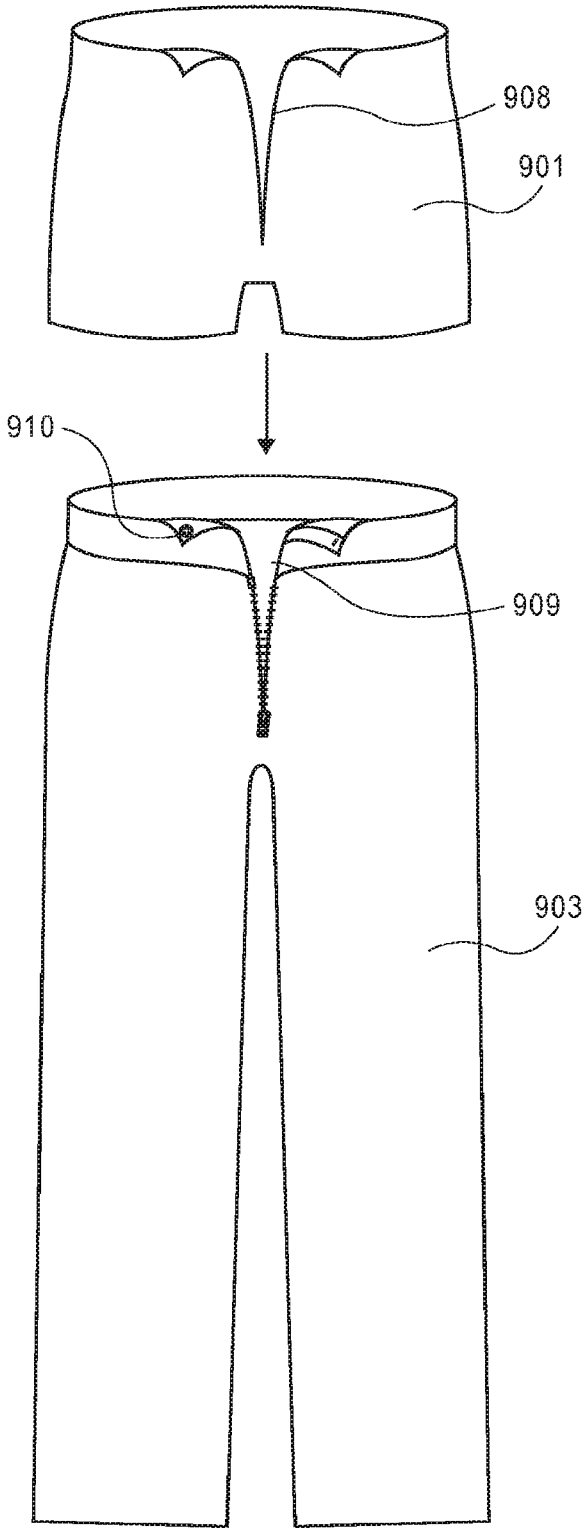
Figure 10:
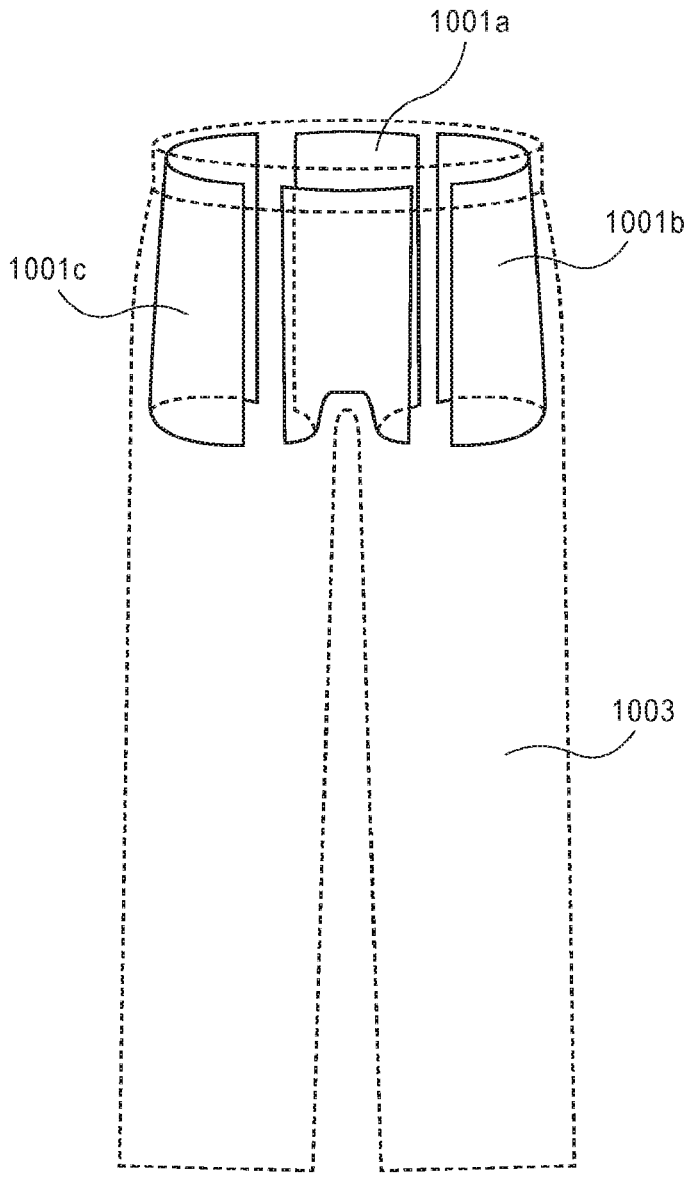
FIG. 10 demonstrates an example of a garment liner that includes multiple separated portions, according to an embodiment of the invention.

Beyond the various mechanisms for fastening the garment liner to the clothing article, in some embodiments, the garment liner can also have modifications in shape, form, and function as compared to typical underwear. For example, FIGS. 9A-9B illustrate a garment liner 901 that includes an openable liner slit 908 (or more generally an opening) located at the front of the garment liner 901. In some embodiments, the liner slit 908 can be a vertically-oriented division across the thickness of the materials of the garment liner 901. The liner slit 908 can range from the top edge (or near the top edge) of the garment liner 901 down to the bottom (or part of the way to the bottom) of the crotch or saddle region.

The liner slit 908 can be positioned, sized, and otherwise configured to be similar to (and paired with) a corresponding clothing slit 909 in a clothing article 903. For example, FIGS. 9A-9B show a clothing slit 909 that can be opened and closed by zipper and/or a button 910. Embodiments allow the clothing slit 909 to include any other suitable mechanisms for opening and closing, such as one or more buttons, snaps, hooks and loops, etc.

Because the liner slit 908 can be positioned adjacent to the clothing slit 909, and because the garment liner 901 can be coupled to the clothing article 903, the liner slit 908 may open and close whenever the clothing slit 909 is opened and closed. As a result, a person's single action of opening the clothing slit 909 (e.g., via unzipping and/or unbuttoning) can cause the liner slit 908 to open and close. FIG. 9A shows the liner slit 908 and the clothing slit 909 in a closed state, and FIG. 9B shows the liner slit 908 and the clothing slit 909 in an opened state.

This can simplify the process of opening and/or remove clothing (e.g., when using the restroom or when changing clothes), as the garment liner 901 can automatically mimic movements in the clothing article 903. A person may not have to perform any additional manipulations for opening or removing the garment liner 901 after performing thus tasks for the clothing article 903.

Conventional underwear cannot include a slit that connects to the top edge because conventional underwear includes an elastic band around the top edge. Accordingly, conventional underwear cannot simulate the opening and closing of the clothing slit 909 in this manner. Conventional underwear instead requires additional manipulations to lower an elastic band or to separate a frontal opening.

In some embodiments, the garment liner 901 can be coupled to the clothing article 903 in one of or a combination of the manners already described above, and this can be sufficient for causing the liner slit 908 to simulate the movements of the clothing slit 909. In other embodiments, additional and/or modified attachment mechanisms can be included in order to better conform the liner slit 908 to the clothing slit 909. For example, extra couplings (e.g., buttons, snaps, Velcro™, adhesives, etc.) can be placed at or near the edges of the liner slit 908 and the edges of the clothing slit 909 in order to firmly couple this areas. This can ensure that the liner slit 908 fully closes when the clothing slit 909 is closed, and that the liner slit 908 immediately opens when the clothing slit 909 is opened. In one example, the couplers 405D and 406D from FIG. 4 can be modified so that they are divided in the region of the liner slit 908 and the clothing slit 909.

Additionally, embodiments allow the garment liner 901 to include additional material so that the edges of the liner slit 908 overlap. This can ensure that there is full garment liner 901 coverage when the clothing slit 909 is closed, and can provide additional protection and cushioning from a zipper. The right edge and/or left edge of the liner slit 908 can include any suitable amount of extra overlapping material (e.g., 1 centimeter, 2 centimeters, 3 centimeters, 4 centimeters, 5 centimeters, 6 centimeters, 7 centimeters, 8 centimeters, 9 centimeters, 10 centimeters, 15 centimeters, 20 centimeters, 30 centimeters, or any other suitable extra length). In some embodiments, when extra couplers are applied to the liner slit 908 area, the extra material can extend beyond the couplers.

In some embodiments, the garment liner 901 can further include a zipper, one or more buttons, and/or any other suitable components on or near the liner slit 908. Accordingly, the liner slit 908 can be more directly controlled if desired.

As mentioned above, the garment liner can take any suitable shape or form, such as the shape of boxers, the shape of briefs, or as multiple separate portions. As an example, FIG. 10 demonstrates a garment liner that includes multiple separate portions. The garment liner can include a center saddle portion 1001A, a left leg portion 1001B, a right leg portion 1001C, and any other suitable subdivision or additional section.

Dividing the garment liner into multiple pieces can provide several advantages. For example, the garment liner can be used with clothing articles 1003 of different sizes if separated into pieces, as the pieces can be allowed to overlap (e.g., when used with smaller pants) or to have gap spaces between the pieces (e.g., when used with larger pants). Additionally, separate sections are less likely to cause fabric bunching or other uncomfortable conditions, as the pieces can move independently, and thus do not pull on each other or otherwise affect each other. In contrast, a tug in one area of a single, full (e.g., non-separated) garment liner unit might cause distortion in a separate, but connected area of the garment liner.

As shown in FIG. 7, the center saddle portion 1001A can be shaped and configured to cover the groin, the inner thighs, the inter-gluteal cleft, some or all of the buttocks, and/or any other suitable central area or saddle area. The left leg portion 1001B and the right leg portion 1001C may be shaped and configured to cover the hips, some portions of the thighs and legs, and/or some portions of the buttocks. In some embodiments, the area where separation occurs between the center saddle portion 1001A and the leg portions may be positioned such that discomfort is minimized. For example, this can mean an area where there is typically lower pressure between the body and the clothing article. Additionally, it can be beneficial to place the division in an area that typically receives less sweat, bacteria, or other soiling (e.g., the hips). As examples, embodiments allow the separation to be positioned on the outside of the each buttock (e.g., near the hips), on an inner portion of each buttock, directly behind each buttock, on the front of the thighs, and/or in any other suitable areas. The left leg portion 1001B and the right leg portion 1001C may each be symmetrical from front to back, or may be unsymmetrical.

Further embodiments allow the liner to be reduced in size and coverage such that only primary areas of the body and clothing article are covered. For example, the left leg portion 1001B and the right leg portion 1001C may be discarded, and just the center saddle portion 1001A may be used.

In some embodiments, the center saddle portion 1001A can be extended to cover more of the legs (e.g., thighs, hips, and buttocks). The center saddle portion 1001A can reach completely around to cover all of the legs. This can allow the center saddle portion 1001A to essentially act as a complete single piece (e.g., not separated into multiple pieces) liner that can fit multiple sizes and shapes of clothing articles. If the clothing article is smaller, the leg portions may overlap at the hips. If the clothing article is larger, the leg portions may not reach entirely, and thus may leave the outer edges of the hips exposed (e.g., the body may contact the clothing article directly at the hips).

In some embodiments, the center saddle portion 1001A can be further subdivided into multiple sections, such as a rear saddle section, a front saddle section, and a middle saddle section. This can allow for further customization and combination of pieces for best-fitting different types and sizes of clothing articles. These different saddle portions may or may not overlap. The front saddle section can be enlarged to provide extra coverage in the genital area. The rear section can be elongated and/or widened to cover the inter-gluteal cleft and/or the buttocks. The middle section can be customized to cover the perineum and/or the inner thighs. In some embodiments, several smaller pieces can be used to compose the middle section, or to otherwise cover gaps or customize to a wearer's preference.

Embodiments of the invention have a number of advantages. For example, in embodiments of the invention, a garment liner can replace underwear. The garment liner can attach directly to a clothing article instead of to a person's body. The garment liner can exclude an elastic band and can conform to the shape of the clothing article. As a result, the garment liner can reduce bunching (e.g., wedgies), misalignment, distortion, twisting, or other uncomortable manipulations that occur with typical undergarments. By attaching to a clothing article instead of the body, a garment liner can be less prone to friction between body and pants, and can thereby stay better aligned and in a comfortable position. Additonally, the garment liner can be separated into mutliple sections, such that the different sections do not pull on or affect each other, and thereby stay better positioned.

Further, embodiments provide a garment liner that can be removable, washable, reusable. The garment liner also may not cause damage or wear to clothing. For example, the garment liner may not leave adhesive residue on a clothing article, and may not remove material from a clothing article (e.g., due to sticking).

As an additional advantage, the garment liner can be customized to cover certain areas as desired, such as thicker padding or more surface area coverage for a saddle area. Different configurations, shapes and sizes can be used to cover surfaces as needed. Various materials can be used to promote cushioning, breathability, softness, attachment to clothing, or other qualities in different areas.

Embodiments allow the garment liner to resemble the appearance of a typical men's undergarment or women's undergarment, so as to overcome social stigmas related to alternative undergarments. For example, a garment liner can have the shape of men's boxers or briefs.

Embodiments can also simulate the feel of typical men's or women's undergarment. For example, a liner can include some amount of free-hanging material to simulate the feel of men's boxers.

While the Figures and description herein primarily discuss applying a garment liner to pants and other lower-body clothing articles (e.g., as a replacement for typical underwear), embodiments of the invention allow the garment liner to be applied to other parts of the body and other types of clothing articles and shoes. For example, a garment liner can be applied to body areas that produce more odor and sweat (e.g., arm pits and upper back), and/or to body areas that benefit from additional padding.

While certain exemplary embodiments have been described in detail and shown in the accompanying drawings, it is to be understood that such embodiments are merely illustrative of and not intended to be restrictive of the broad invention, and that this invention is not to be limited to the specific arrangements and constructions shown and described, since various other modifications may occur to those with ordinary skill in the art.

As used herein, the use of "a", "an" or "the" is intended to mean "at least one", unless specifically indicated to the contrary.

What is claimed is:

1. A system comprising:

a clothing article, wherein the clothing article is long pants;

a garment liner including at least one layer of fabric, wherein the garment liner is positioned within the clothing article, a bottom edge of the garment liner is positioned above the knee, the garment liner is loose-fitting, and the garment liner does not include an elastic band encircling an upper area of the garment liner;

a first set of one or more couplers attached to an exterior surface of the garment liner, the first set of one or more couplers encircling the upper area of the garment liner;

a second set of one or more couplers attached to an interior surface of the clothing article, the second set of one or more couplers encircling an upper space within the clothing article, wherein the second set of one or more couplers are detachably connected to the first set of one or more couplers;

a third set of one or more couplers attached to the exterior surface of the garment liner, the third set of one or more couplers encircling a right thigh area of the garment liner;

a fourth set of one or more couplers attached to the interior surface of the clothing article, the fourth set of one or more couplers encircling a right thigh space within the clothing article, wherein the third set of one or more couplers are detachably connected to the fourth set of one or more couplers;

a fifth set of one or more couplers attached to the exterior surface of the garment liner, the fifth set of one or more couplers encircling a left thigh area of the garment liner; and a sixth set of one or more couplers attached to the interior surface of the clothing article, the sixth set of one or more couplers encircling a left thigh space within the clothing article, wherein the fifth set of one or more couplers are detachably connected to the sixth set of one or more couplers.

2. The system of claim 1, wherein the at least one layer of fabric includes a first slit that is vertically-oriented, that is located in a front crotch area of the garment liner, and that extends downward from a top edge of the garment liner, wherein the clothing article includes a second slit, and wherein the garment liner is positioned within the clothing article such that the first slit and the second slit are adjacent.

3. The system of claim 2, wherein the first set of one or more couplers is divided by the first slit, and the second set of one or more couplers is divided by the second slit.

4. The system of claim 2, wherein an action of opening the second slit causes the first slit to open such that a single action opens both the first slit and the second slit.

5. The system of claim 2, wherein the first slit includes a first edge and a second edge, and wherein the garment liner does not include components for directly fastening the first edge to the second edge.

6. The system of claim 1, wherein the garment liner has a shape of boxer underwear or brief underwear, and wherein the garment liner conforms to the clothing article.

7. The system of claim 1, wherein a first distance is between the first set of one or more couplers and the third set of one or more couplers, a second distance is between the second set of one or more couplers and the fourth set of one or more couplers, a third distance is between the first set of one or more couplers and the fifth set of one or more couplers, a fourth distance is between the second set of one or more couplers and the sixth set of one or more couplers, the first distance is the same as the second distance, and the third distance is the same as the fourth distance such that the garment liner conforms to a shape of the clothing article.

8. The system of claim 1, wherein the third set of one or more couplers are a third set of one or more magnets, the fourth set of one or more couplers are a fourth set of one or more magnets, the fifth set of one or more couplers are a fifth set of one or more magnets, the sixth set of one or more couplers are a sixth set of one or more magnets, the third set of one or more magnets are configured for detachably connecting to the fourth set of one or more magnets when the garment liner is inserted into the clothing article, and the fifth set of one or more magnets are configured for detachably connecting to the sixth set of one or more magnets when the garment liner is inserted into the clothing article.

9. The system of claim 1, wherein the first set of one or more couplers is in the form of a single strip, and the second set of one or more couplers is in the form of a single strip.

10. The system of claim 1, wherein the third set of one or more couplers are located at a first bottom end of the garment liner, the fourth set of one or more couplers are not located at a second bottom end of the clothing article such that that a right leg portion of the clothing article extends downward beyond the fourth set of one or more couplers, the fifth set of one or more couplers are located at a third bottom end of the garment liner, and the sixth set of one or more couplers are not located at a fourth bottom end of the clothing article such that that a left leg portion of the clothing article extends downward beyond the sixth set of one or more couplers.

11. A garment liner, comprising:

a fabric layer;

a slit in the fabric layer, wherein the slit is vertically-oriented, located in a front crotch area of the fabric layer, and extends downward from a top edge of the fabric layer;

a first set of one or more couplers attached to an exterior surface of the fabric layer, the first set of one or more couplers encircling a right thigh area of the fabric layer;

a second set of one or more couplers attached to the exterior surface of the fabric layer, the second set of one or more couplers encircling a left thigh area of the fabric layer; and a third set of one or more couplers attached to the exterior surface of the fabric layer, the third set of one or more couplers being disposed at least below the slit.

12. The garment liner of claim 11, wherein the first set of one or more couplers are a first set of one or more magnets, wherein the second set of one or more couplers are a second set of one or more magnets, wherein the first set of one or more magnets are configured for detachably connecting to a corresponding fourth set of one or more magnets at an interior surface of a clothing article when the garment liner is inserted into the clothing article, and wherein the second set of one or more magnets are configured for detachably connecting to a corresponding fifth set of one or more magnets at the interior surface of the clothing article when the garment liner is inserted into the clothing article.

13. The garment liner of claim 11, wherein the third set of one or more couplers includes a first elongated strip vertically disposed along a first edge of the slit.

14. The garment liner of claim 13, wherein the third set of one or more couplers further includes a second elongated strip vertically disposed along a second edge of the slit, wherein the first elongated strip and the second elongated strip both include hook-and-loop type fasteners.

15. The garment liner of claim 11, wherein the first set of one or more couplers are located at a first bottom end of the fabric layer, the second set of one or more couplers are located at a second bottom end of the fabric layer, the garment liner does not include an elastic band encircling an upper area of the fabric layer, the fabric layer has a shape of boxer underwear or brief underwear, and the fabric layer extends from a waist area to the right thigh area and the left thigh area.

16. A system comprising:

a garment liner, the garment liner including:

a fabric layer; and a first slit in the fabric layer, the first slit including a first edge and a second edge that extend downward from a top edge of the fabric layer at a front area of the fabric layer;

a clothing article, wherein the clothing article includes a second slit with a third edge and a fourth edge, and wherein the garment liner is positioned within the clothing article such that the first slit and the second slit are adjacent;

a first set of one or more couplers attached to an exterior surface of the garment liner, the first set of one or more couplers being disposed at least below the first slit; and a second set of one or more couplers attached to an interior surface of the clothing article, the second set of one or more couplers being disposed at least below the second slit, wherein the first set of one or more couplers are detachably connected to the second set of one or more couplers.

17. The system of claim 16, wherein the first set of one or more couplers include a first magnet disposed below the first slit, and wherein the second set of one or more couplers include a second magnet disposed below the second slit.

18. The system of claim 16, further comprising:

a third set of one or more couplers attached to the exterior surface of the garment liner, the third set of one or more couplers encircling an upper area of the garment liner; and a fourth set of one or more couplers attached to the interior surface of the clothing article, the fourth set of one or more couplers encircling an upper space within the clothing article, wherein the second set of one or more couplers are detachably connected to the first set of one or more couplers.

19. The system of claim 16, wherein the first set of one or more couplers include at least one first button or first snap, and the second set of one or more couplers include at least one second buttonhole or second snap, wherein an action of opening the second slit causes the first slit to open such that a single action opens both the first slit and the second slit, and wherein the garment liner does not include components for directly fastening the first edge to the second edge.

20. The system of claim 16, wherein the fabric layer has a shape of boxer underwear or brief underwear, the fabric layer extends from a waist area to a right thigh area and a left thigh area, and the garment liner does not include an elastic band encircling an upper area of the fabric layer.

* * * * *